US012035832B2

(12) United States Patent
Wilkinson

(10) Patent No.: US 12,035,832 B2
(45) Date of Patent: Jul. 16, 2024

(54) PILLOW

(71) Applicant: Brodie Wilkinson, Vancouver (CA)

(72) Inventor: Brodie Wilkinson, Vancouver (CA)

( * ) Notice: Subject to any disclaimer, the term of this patent is extended or adjusted under 35 U.S.C. 154(b) by 85 days.

(21) Appl. No.: 17/306,064

(22) Filed: May 3, 2021

(65) Prior Publication Data

US 2022/0346575 A1 Nov. 3, 2022

(51) Int. Cl.

| | |
|---|---|
| ***A47G 9/10*** | (2006.01) |
| ***A47C 20/02*** | (2006.01) |
| ***A47G 9/02*** | (2006.01) |

(52) U.S. Cl.

CPC ..... *A47G 9/10* (2013.01); *A47G 9/0253* (2013.01); *A47C 20/02* (2013.01); *A47G 2009/1018* (2013.01); *A47G 9/1063* (2013.01); *A47G 9/1072* (2013.01); *A47G 9/109* (2013.01)

(58) Field of Classification Search

CPC .. A47G 9/10; A47G 2009/1018; A47G 9/109; A47G 9/1063; A47G 9/0253; A47G 9/1072; A47G 9/1081; A47G 9/1009; A47G 9/1054; A47G 9/1045; A47G 9/1027; A47G 9/1036; A47G 9/007; A47C 20/00; A47C 20/023; A47C 20/02; A47C 7/38; A47C 7/36; A47C 7/383; A47C 20/027; A47C 20/026; A47C 20/025; Y10S 5/93

See application file for complete search history.

(56) References Cited

U.S. PATENT DOCUMENTS

| | | | | |
|---|---|---|---|---|
| 5,644,809 | A * | 7/1997 | Olson | A47G 9/1081 5/639 |
| D618,944 | S * | 7/2010 | Rothstein | D6/601 |
| 8,069,515 | B1 * | 12/2011 | Tingey | A47G 9/10 5/636 |
| 9,629,487 | B1 * | 4/2017 | Kvitek | A47G 9/10 |
| 2008/0066233 | A1 * | 3/2008 | Russell | A47G 9/1036 5/951 |
| 2010/0242179 | A1 * | 9/2010 | Berke | A47G 9/10 5/636 |

* cited by examiner

*Primary Examiner* — David R Hare
*Assistant Examiner* — Deborah Talitha Gedeon
(74) *Attorney, Agent, or Firm* — Orin Del Vecchio

(57) ABSTRACT

A pillow configured to accommodate a first user and a second user wherein the users are positioned in a lateral recumbent position. The body of the pillow includes an upper portion and a lower portion. The upper portion has an upper surface that is higher than that of the upper surface of the lower portion. The lower portion includes a first section and a second section that are contiguously formed. The first section and second section are laterally adjacent and are configured to permit the second user to lay in a left lateral recumbent position and a right lateral recumbent position. The lower surface of the body includes a passage formed therein. The passage is concave in form and includes a bottom portion and a top portion having a first branch and a second branch. The passage bifurcates proximate the lower edge of the upper portion to create a y-shape.

11 Claims, 3 Drawing Sheets

PILLOW

FIELD OF THE INVENTION

The present invention relates generally to pillows, more specifically but not by way of limitation, a pillow that is configured to accommodate two users wherein the users are supported in both a left lateral recumbent position and a right lateral recumbent position.

BACKGROUND

As is known in the art, pillows are widely utilized for various tasks such as but not limited to sleeping and sitting. There are numerous types of pillows that range in various sizes and shapes depending upon what the intended use is of the pillow. Body pillows are shaped like traditional bed pillows but are typically much longer typically being three feet or more in length. Other exemplary pillows and those that are designed to support infants or small children in a desirable position on the floor for resting. Pillows are designed to most commonly support their head and neck of the user to ensure comfort while in a desired position.

Many people will lay in a recumbent position while watching television or a movie. People will often either be superposed on a bed or on the floor while engaging in the pastime of watching movies or the like. When laying in the recumbent position it is common for an individual to further position themselves laterally wherein the lateral recumbent position is defined as laying down on either a left side or right side of the body. When laying in a left or right lateral recumbent position, a user will often attempt to utilize pillows in order to achieve a desired comfort level while in the position. Additionally, it is common for two individuals to lay together wherein the individuals are both in a left or right laterally recumbent position and are adjacent each other. When two individuals are adjacent each other in a laterally recumbent position, it is difficult to utilize existing pillow technology to achieve both a desired comfort level and a position wherein both individuals can view a television screen.

It is intended within the scope of the present invention to provide a pillow that is configured to accommodate and position a first user and a second user simultaneously in either a left lateral recumbent position or a right lateral recumbent position wherein the first user and second user are adjacent each other.

SUMMARY OF THE INVENTION

It is the object of the present invention to provide a pillow that is configured to accommodate and position a first user and a second user simultaneously in either a left lateral recumbent position or a right lateral recumbent position wherein the pillow of the present invention includes a body having an upper portion and a lower portion.

Another object of the present invention is to provide a pillow that is operable to receive two users in an adjacent lateral recumbent position for both users wherein the lower portion includes a first section and a second section.

A further object of the present invention is to provide a pillow that is configured to accommodate and position a first user and a second user simultaneously in either a left lateral recumbent position or a right lateral recumbent position wherein the first section and second section of the lower portion are contiguous and laterally adjacent to each other.

Still another object of the present invention is to provide a pillow that is operable to receive two users in an adjacent lateral recumbent position for both users wherein the upper portion is contiguous with the lower portion and includes an upper surface that is higher than that of the upper surface of the lower portion.

An additional object of the present invention is to provide a pillow that is configured to accommodate and position a first user and a second user simultaneously in either a left lateral recumbent position or a right lateral recumbent position wherein the body of the pillow includes a lower surface.

Yet a further object of the present invention is to provide a pillow that is operable to receive two users in an adjacent lateral recumbent position for both users wherein the lower surface has formed therein a passage.

Another object of the present invention is to a provide a pillow that is configured to accommodate and position a first user and a second user simultaneously in either a left lateral recumbent position or a right lateral recumbent position wherein the passage is a indentation on the lower surface and is modified Y-shaped.

An alternate object of the present invention is to provide a pillow that is operable to receive two users in an adjacent lateral recumbent position for both users wherein the passage is configured to receive a user's arm therethrough wherein the passage provides the ability for a user to place their arm in a first position and a second position.

Still a further object of the present invention is to provide a pillow that is configured to accommodate and position a first user and a second user simultaneously in either a left lateral recumbent position or a right lateral recumbent position wherein the body further includes a removable outer covering and wherein the outer covering includes at least one pocket.

An additional object of the present invention is to provide a pillow that is operable to receive two users in an adjacent lateral recumbent position for both users wherein the body is manufactured from a suitable foam or similar material.

An additional object of the present invention is to provide a pillow that is configured to accommodate and position a first user and a second user simultaneously in either a left lateral recumbent position or a right lateral recumbent position wherein the upper portion of the body places the head of the user engaged therewith at a level higher than the user engaged with the lower portion of the body.

Still a further object of the present invention is to provide a pillow that is operable to receive two users in an adjacent lateral recumbent position for both users that is configured to accommodate and position a first user and a second user simultaneously in either a left lateral recumbent position or a right lateral recumbent position wherein the lower portion of body places the head of the user engaged therewith towards the lateral side of the pillow versus the central position of the user engaged with the upper portion.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
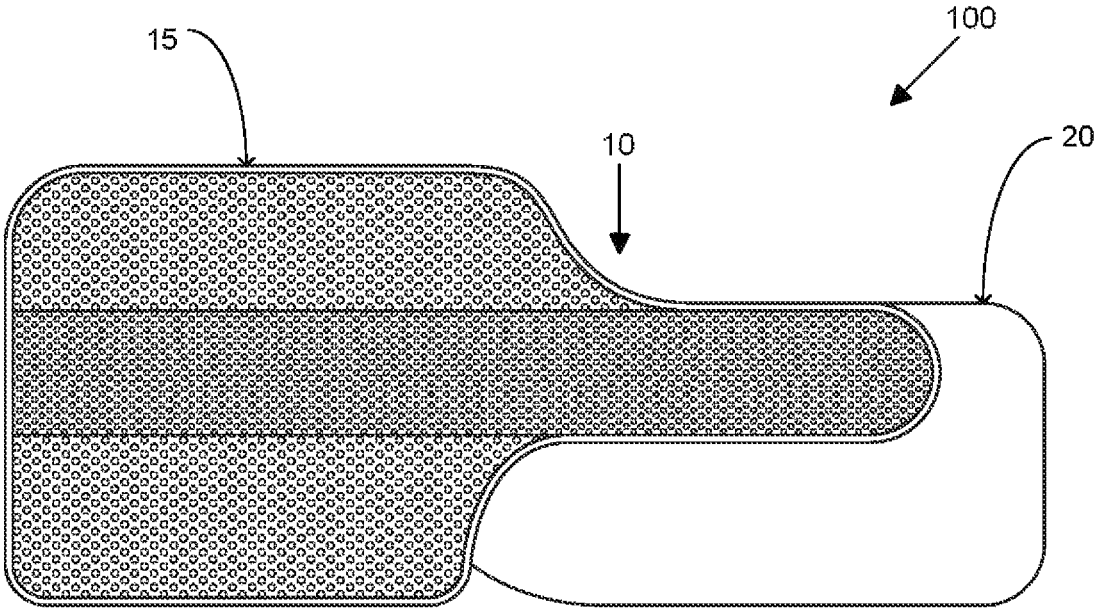
FIG. 1 is a side view of the present invention.
Figure 2:
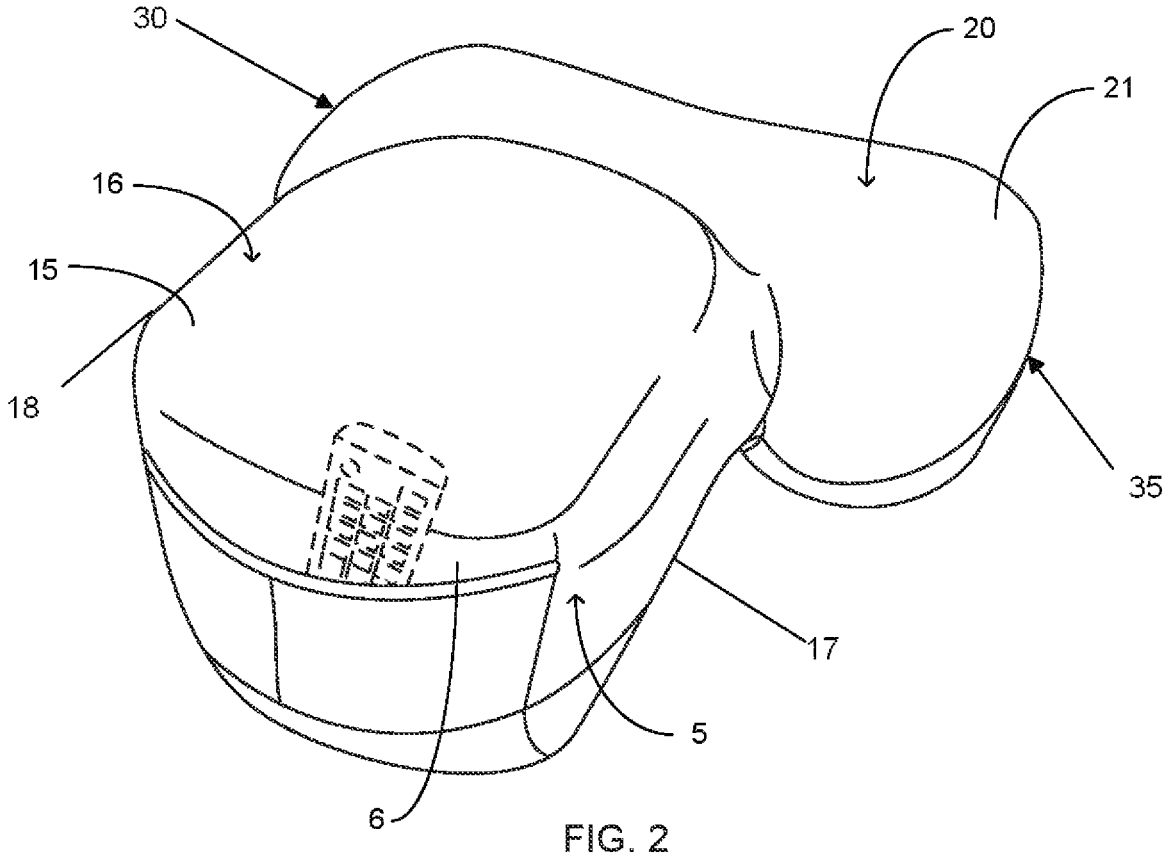
FIG. 2 is a top rear perspective view of the present invention.
Figure 3:
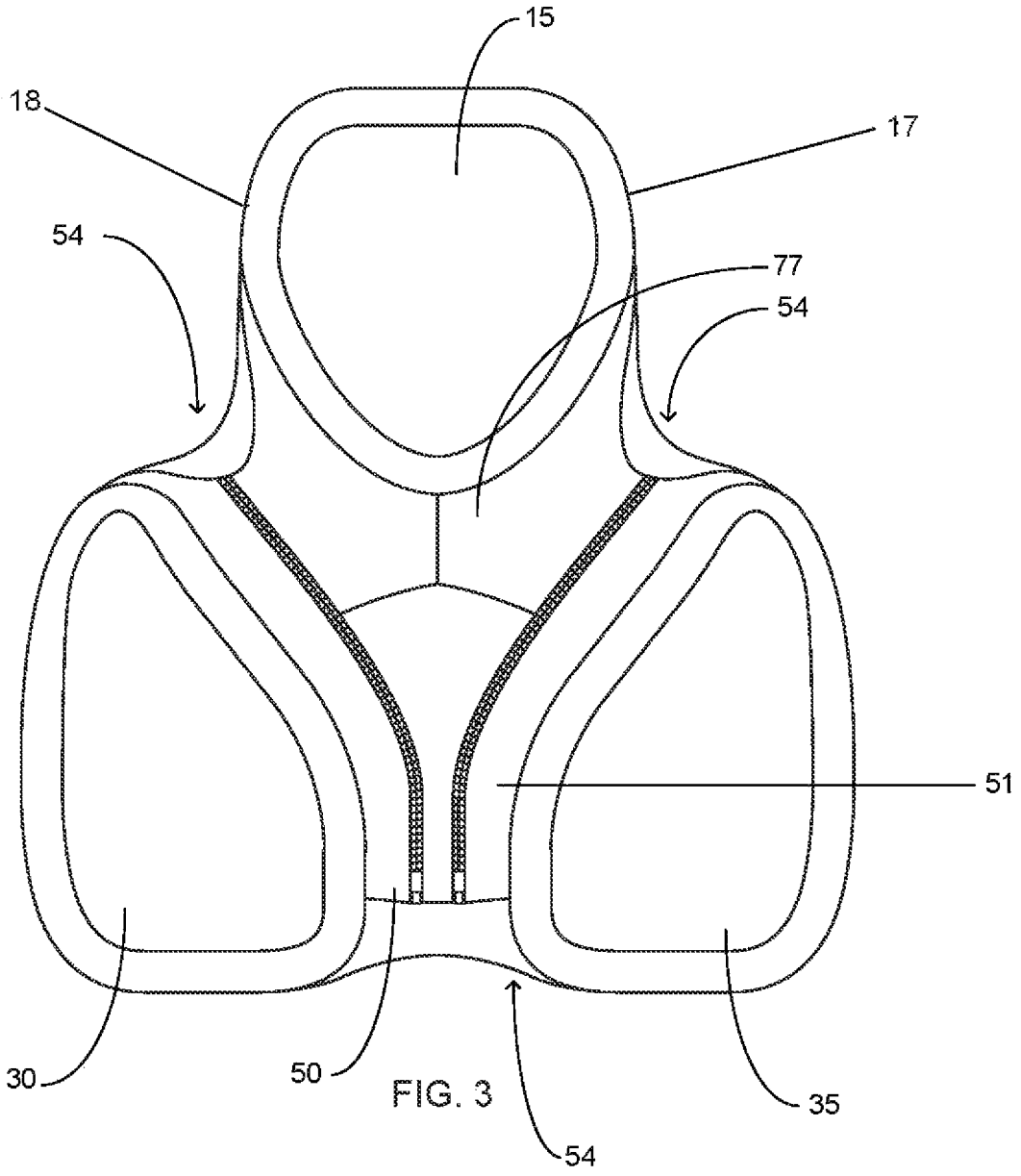
FIG. 3 is a bottom view of the present invention.

Referring now to the drawings submitted herewith, wherein various elements depicted therein are not necessarily drawn to scale and wherein through the views and figures like elements are referenced with identical reference numerals, there is illustrated a pillow 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring now to the Figures submitted as a part hereof, the pillow 100 includes a body 10 wherein the body 10 is manufactured from a suitable material such as but not limited to foam. It should be understood within the scope of the present invention that the body 10 could be manufactured from various different materials in order to provide alternate densities thereof. Furthermore, it is contemplated within the scope of the present invention that the body 10 could be manufactured so as to have different layers. Lastly, it should be understood within the scope of the present invention that the body 10 could be manufactured in alternate sizes and thicknesses.

The body 10 includes an upper portion 15 and a lower portion 20. The upper portion 15 and lower portion 20 are contiguously formed into an approximate T-shape, with the lower portion 20 being wider than the upper portion 15. The upper portion 15 has upper surface 16 wherein the upper surface 16 is higher than that of the upper surface 21 of the lower portion 20. The upper portion 15 further has a front side 17 and a rear side 18. The positioning of the upper surface 16 of the upper portion 20 facilitates the head of the rear user 98 to be above that of the head of the front user 99 wherein the front user 99 has their head superposed the upper surface 21 of the lower portion 20. A cover 5 is releasably secured to the body 10 and is designed to be removable in order to facilitate the cleaning thereof. The cover 5 is manufactured from a suitable material such as but not limited to cotton or polyester. The cover 5 includes a pocket 6 wherein the pocket 6 is formed to receive and retain items such as but not limited to a remote control. It should be understood within the scope of the present invention that the cover 5 could include various quantities and sizes of pockets 6. Furthermore, it should be understood within the scope of the present invention that the cover 5 could have pockets in alternate locations in addition to and/or in conjunction with the pocket 6 illustrated herein.

Figure 4:
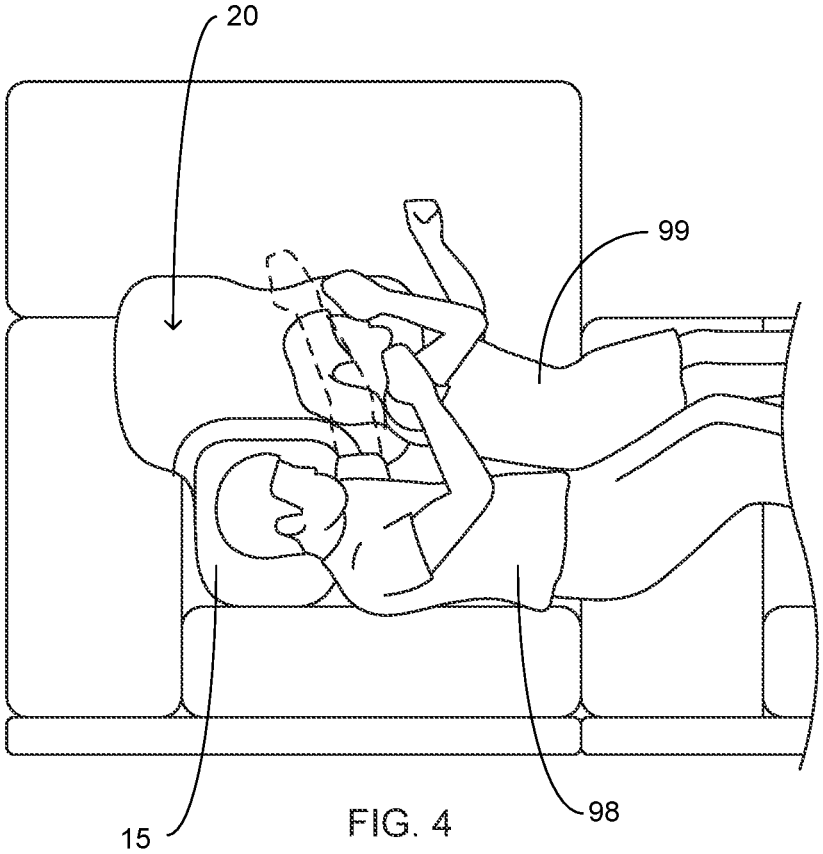
FIG. 4 is a top diagrammatic view of the present invention with a user's arm in a first position.
Figure 5:
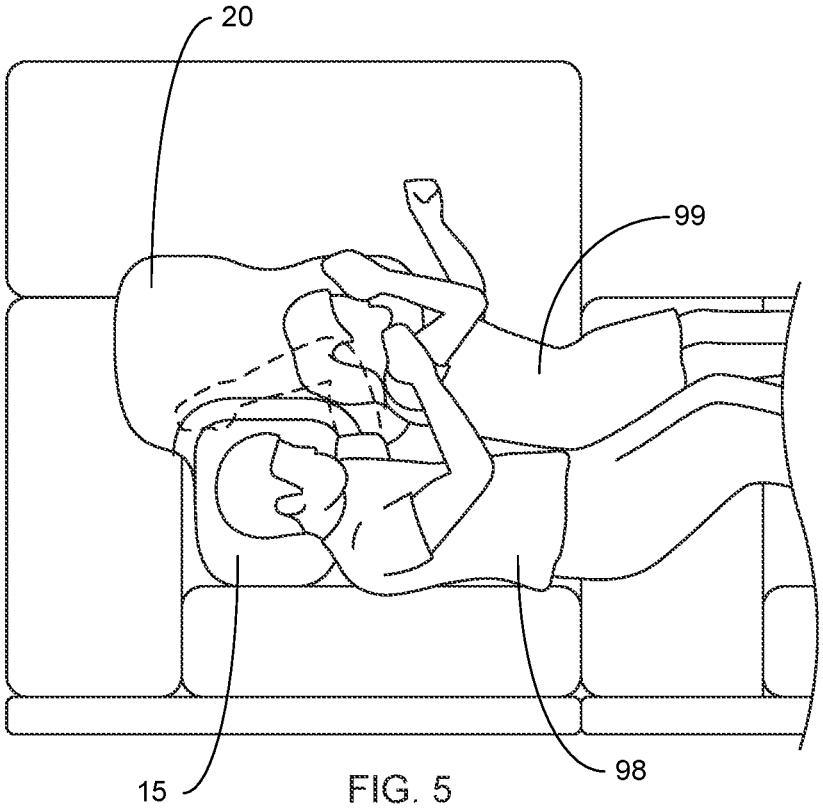
FIG. 5 is a top diagrammatic view of the present invention with a user's arm in a second position.

The lower portion 20 of the body 10 is comprised of a first section 30 which extends beyond the rear side 18 of the upper portion 15 and a second section 35 which extends beyond the front side 17 of the upper portion 15. The first section 30 and second section 35 are laterally adjacent separate by the bottom portion 51 of the passage 50. The first section 30 and second section 35 are similarly shaped and are configured to receive a head of the front user 99. Employing the first section 30 and the second section 35 provides an ability for the lower portion 20 to receive a head of a front user 99 wherein the front user 99 can be accommodated in a left lateral recumbent position and a right lateral recumbent position and the rear user 98 has their head positioned above and to the left or right of the head of the front user when in a similar left lateral or right lateral recumbent position. It should be understood within the scope of the present invention that the first section 30 and second section 35 could be formed in alternate sizes and shapes and still achieve the desired objective stated herein. Further, the designations of front side 17 and rear side 18 are not intended to be limiting, merely illustrative of one embodiment as shown in FIGS. 4 and 5, as the pillow 100 accommodates both a left lateral recumbent position and a right lateral recumbent position.

The body 10 includes a passage 50 formed in the lower surface thereof. The passage 50 is a concave indentation that dissects the first section 30 and second section 35 and further bifurcates proximate the lower end 77 of the upper portion 15 so as to branch to both sides thereof. The passage 50 is generally y-shaped having three openings 54 providing access thereto. The passage 50 is of suitable depth so as to accommodate a human arm therein. The passage 50 provides a rear user 98 an ability to position their downward arm in either a first position and a second position. As is illustrated herein in FIGS. 4 and 5, the rear user 98 can place their downward arm such that the downward arm extends forward of the front user 99 as shown in FIG. 4. Alternatively, the bifurcation of the passage 50 provides the ability for the rear user 98 place their downward arm in a second position wherein the downward arm extends away from the head of the rear user 98. While a bifurcated passage 50 is illustrated herein, it is contemplated within the scope of the present invention that the passage 50 could be formed in alternate shapes wherein the alternate shape could provide as few as one position for the downward arm of the rear user 98 or more than two positions for the downward arm of the rear user 98.

While not particularly illustrated herein, it is contemplated within the scope of the present invention that the body 10 could have slits or a similar structure formed therein wherein the slits are configured to releasably secure a small electronic device such as but not limited to a smart phone. The aforementioned structure would provide a technique to retain an electronic device and utilize the pillow 100. While the preferred embodiment of the pillow 100 illustrated herein includes a lower portion 20 having a first section 30 and a second section 35 so as to accommodate both a left lateral recumbent position and right lateral recumbent position, it is contemplated within the scope of the present invention that the body 10 could have a one piece lower portion 20 configured to accommodate one lateral recumbent position.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A pillow that is configured to accommodate a first user and a second user wherein the first user and second user are positioned in a lateral recumbent position wherein the pillow comprises: a body, said body having an upper portion and a lower portion, said upper portion having an upper surface, a lower surface, a front side and a rear side, said lower portion having an upper surface and a lower surface, said upper portion being adjacent said lower portion, said upper surface of said lower portion being lower than that of the upper surface of said upper portion, said lower portion extending laterally beyond both the front side and the rear side of said upper portion, said upper portion configured to receive a head of the first user, said lower portion configured to receive a head of the second user in a position below and beneath the head of the first user to provide a clear line of sight for the first user over the second user; a passage, said passage being formed in the lower surface of said body, said passage extending intermediate the front side and rear side of the body and extending laterally beyond both the front side and the rear side of said upper portion, said passage being concave in form and being of suitable size to accommodate a human arm therein, said passage having three openings converging in a center of the pillow and providing two alternate positions for a downward arm of the first user, one position with the downward arm extended forward through a first and a second of the three openings and a second position with the downward arm in a bent position through a first and a third of the three openings exiting the rear side, wherein the first user may position the arm between either of the two alternate positions without a change in the lateral recumbent position.

2. The pillow configured to accommodate a first user and a second user as recited in claim 1, wherein the body further includes a cover, said cover configured to be releasably secured to said body.

3. The pillow configured to accommodate a first user and a second user as recited in claim 2, wherein said cover further includes at least one pocket formed therein.

4. The pillow configured to accommodate a first user and a second user as recited in claim 3, wherein said body is manufactured from foam.

5. The pillow configured to accommodate a first user and a second user as recited in claim 4, wherein said passage includes a first opening on said front side of said body and a second opening on said rear side of said body.

6. A pillow that is configured to accommodate a first user and a second user wherein the first user and second user are positioned in a lateral recumbent position wherein the pillow comprises: a body, said body having an upper portion and a lower portion, said upper portion having an upper surface, a lower surface, an front side and a rear side, said lower portion having an upper surface and a lower surface, said upper portion being adjacent said lower portion, said lower portion having a first section and a second section, said first section and said second section of said lower portion being laterally adjacent, said upper surface of said lower portion being lower than that of the upper surface of said upper portion, said lower portion extending laterally beyond both the front side and the rear side of said upper portion, said upper portion configured to receive a head of the first user, said first section of said lower portion configured to receive a head of the second user in a position below and beneath the head of the first user wherein the second user is in a left lateral recumbent position, said second section of said lower portion configured to receive a head of the second user in a position below and beneath the head of the first user wherein the second user is in a right lateral recumbent position; a passage, said passage being formed in the lower surface of said body, said passage being concave in formation in the lower surface of the body, said passage dissecting the first section and the second section of the lower portion of the body and extending laterally beyond both the front side and the rear side of said upper portion, said passage having a bifurcation proximate a lower edge of the upper portion, said passage having a first upper section and a second upper section, said first upper section and said second upper section of said passage having openings on the front and rear sides of the body, said openings converging in a center of the pillow; and wherein the passage is configured to provide a first position and a second position for a downward arm of the first user one position with the downward arm extended forward through a first and a second of the three openings and a second position with the downward arm in a bent position through a first and a third of the three openings exiting the rear side, and wherein the first user may position the arm between either of the two positions without a change in the lateral recumbent position.

7. The pillow that is configured to accommodate a first user and a second user as recited in claim 6, wherein the passage includes an opening proximate the lower portion intermediate the first section and second section of the lower portion of said body.

8. The pillow that is configured to accommodate a first user and a second user as recited in claim 6, wherein the first position of the downward arm of the first user places the downward arm so as to extend outward from the second user.

9. The pillow that is configured to accommodate a first user and a second user as recited in claim 8, wherein the body includes a cover, said cover being releasably secured thereto, said cover having at least one pocket formed therein.

10. The pillow that is configured to accommodate a first user and a second user as recited in claim 9, wherein the second position of the downward arm of the first user places the downward arm so as to extend outward from a head of the first user.

11. The pillow that is configured to accommodate a first user and a second user as recited in claim 10, wherein the body is manufactured from foam.

* * * * *